US008457536B2

(12) United States Patent
Nakamatsu et al.

(10) Patent No.: US 8,457,536 B2
(45) Date of Patent: Jun. 4, 2013

(54) TRANSFER DEVICE AND IMAGE FORMING APPARATUS INCLUDING SAME

(75) Inventors: Hiroki Nakamatsu, Tokyo (JP); Masakazu Imai, Tokyo (JP); Katsuhito Haruno, Tokyo (JP); Seiichi Kogure, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 297 days.

(21) Appl. No.: 12/923,090

(22) Filed: Sep. 1, 2010

(65) Prior Publication Data

US 2011/0058859 A1 Mar. 10, 2011

(30) Foreign Application Priority Data

Sep. 7, 2009 (JP) ..... 2009-206116

(51) Int. Cl.

| | |
|---|---|
| ***G03G 15/16*** | (2006.01) |
| ***G03G 15/08*** | (2006.01) |
| ***G03G 15/01*** | (2006.01) |
| ***G03G 15/20*** | (2006.01) |
| ***G03G 21/00*** | (2006.01) |

(52) U.S. Cl.

USPC ..... 399/302; 399/66; 399/101; 399/121; 399/308; 399/346

(58) Field of Classification Search

USPC ..... 399/66, 71, 99, 101, 121, 123, 302, 399/308, 346, 353, 354

See application file for complete search history.

(56) References Cited

U.S. PATENT DOCUMENTS

| | | | | |
|---|---|---|---|---|
| 6,885,842 | B2 * | 4/2005 | Sawai | 399/302 |
| 2008/0118285 | A1 * | 5/2008 | Karasawa | 399/346 |
| 2008/0131180 | A1 | 6/2008 | Kishi | |
| 2009/0035038 | A1 | 2/2009 | Sugimoto et al. | |
| 2009/0092428 | A1 | 4/2009 | Yano et al. | |
| 2009/0257799 | A1 | 10/2009 | Haruno et al. | |
| 2009/0311004 | A1 | 12/2009 | Naruse et al. | |
| 2010/0003051 | A1 | 1/2010 | Sekina et al. | |
| 2010/0003052 | A1 | 1/2010 | Nakamatsu et al. | |
| 2010/0008696 | A1 | 1/2010 | Furuya et al. | |
| 2010/0008706 | A1 | 1/2010 | Sugiura et al. | |
| 2010/0034549 | A1 | 2/2010 | Nakamatsu et al. | |
| 2010/0067952 | A1 | 3/2010 | Fujita et al. | |
| 2010/0080625 | A1 | 4/2010 | Furuya et al. | |
| 2010/0239302 | A1 | 9/2010 | Naruse et al. | |

FOREIGN PATENT DOCUMENTS

| | | |
|---|---|---|
| CN | 1363860 | 8/2002 |
| JP | 2008-122601 | 5/2008 |

OTHER PUBLICATIONS

Office Action dated Apr. 6, 2012 issued in corresponding Chinese Application No. 201010271325.5.

* cited by examiner

*Primary Examiner* — Joseph S Wong

(74) *Attorney, Agent, or Firm* — Harness, Dickey & Pierce, P.L.C.

(57) ABSTRACT

A transfer device includes a rotatable intermediate transfer belt wound around and stretched between a pair of rollers, facing a plurality of image bearing members bearing toner images, a plurality of transfer members facing the image bearing members through the intermediate transfer member, to transfer overlappingly the toner images onto the intermediate transfer member forming a composite toner image, a lubricant applicator disposed upstream from the image bearing members in a direction of rotation of the intermediate transfer belt and on the same plane as the image bearing members, to apply a lubricant on the intermediate transfer member, an opposing member disposed opposite the lubricant applicator, to contact the lubricant applicator through the intermediate transfer member, and a pressure member disposed upstream from the image bearing members and downstream from the lubricant applicator in the direction of rotation of the intermediate transfer belt, to press against the intermediate transfer member.

16 Claims, 5 Drawing Sheets

TRANSFER DEVICE AND IMAGE FORMING APPARATUS INCLUDING SAME

CROSS-REFERENCE TO RELATED APPLICATIONS

This patent application is based on and claims priority pursuant to 35 U.S.C. §119 from Japanese Patent Application No. 2009-206116, filed on Sep. 7, 2009 in the Japan Patent Office, which is hereby incorporated herein by reference in its entirety.

BACKGROUND OF THE INVENTION

1. Field of the Invention

Exemplary aspects of the present invention generally relate to a transfer device and an image forming apparatus, such as a copier, a facsimile machine, a printer, or a multi-functional system including a combination thereof, and more particularly, to a transfer device including a belt-type transfer member and an image forming apparatus including the transfer device.

2. Description of the Background Art

Conventionally, there is known a transfer device employed in, but not limited to, image forming apparatuses, such as copiers, printers, facsimile machines, and multifunctional systems including at least two of these functions, in which an endless looped belt is employed as an intermediate transfer member for transferring images.

Typically, a color image forming apparatus is equipped with a plurality of cylindrical photoreceptors serving as image bearing members, one for each color, and a belt-type intermediate transfer member (hereinafter referred to as an intermediate transfer belt). The intermediate transfer belt is disposed across from and in contact with the photoreceptors which rotate at a certain speed, and rotates at the same peripheral speed as that of the photoreceptors.

Such a color image forming apparatus equipped with the intermediate transfer belt includes also a developing device, a primary transfer device, and a secondary transfer device. The developing device develops latent images of different colors formed on the photoreceptors into toner images. The primary transfer device transfers overlappingly and sequentially the toner images formed on the photoreceptors-onto the intermediate transfer belt, thereby foaming a composite color toner image thereon. Then, the secondary transfer device transfers the composite color toner image from the intermediate transfer belt onto a transfer material, for example, a recording medium, thereby ultimately forming a color image.

As the composite toner image is transferred from the intermediate transfer belt to the transfer material, it is not always the case that the toner of the composite toner image is transferred completely onto the transfer material. That is, undesirably, some residual toner remains on the intermediate transfer belt. Thus, a cleaning device, often constructed of a cleaning blade made of rubber or resin, is provided to clean the residual toner from the intermediate transfer belt. However, removal of the residual toner by the cleaning blade is becoming more difficult in recent years as toner consisting of very fine spherical particles increasingly comes to be used to satisfy growing market demand for the production of images of ever-higher quality.

A conventional method of facilitating removal of residual toner employs a lubricant which is applied on the surface of the intermediate transfer belt to reduce adherence between the intermediate transfer belt and the residual toner. Generally, the lubricant is applied on the intermediate transfer belt using an application member, for example, a brush roller. The brush roller consists of a metal core around which a fabric with brush bristles is attached, thereby rubbing the lubricant retained on the brush bristles onto the intermediate transfer belt.

Application of the lubricant is best accomplished in the absence of residual toner. Thus, the lubricant is usually applied to the intermediate transfer belt after the intermediate transfer belt is cleaned by the cleaning device.

In such a conventional method, a roller (hereinafter referred to as an opposing roller) is disposed opposite the brush roller through the intermediate transfer belt (that is, on a side of the belt opposite the side on which the brush roller is disposed) to press the spanned surface of the intermediate transfer belt against the tip of the brush roller so that the tip of the brush roller can reliably contact the surface of the intermediate transfer belt while preventing rippling of the intermediate transfer belt as well. For example, the amount of the tip of the brush bristles of the brush roller engaging the belt surface is approximately 1 mm.

Although advantageous, there is a drawback to this configuration in that, because the tip of the brush roller engages the belt surface to a depth of approximately 1 mm, the brush roller contacts not only the portion of the intermediate transfer belt contacting the opposing roller, but also other areas of the intermediate transfer belt not contacting the opposing roller, for example, areas adjacent to both ends of the contact area of the intermediate transfer belt with the opposing roller.

As a result, when pressed by the tip of the brush roller, the portion of the intermediate transfer belt where the opposing roller does not contact the belt deforms under pressure from the brush. (By contrast, when pressed by the tip of the brush roller, the portion of the intermediate transfer belt contacting the opposing roller is prevented from being deformed.) When the tip of the brush roller separates from the intermediate transfer belt, the intermediate transfer belt flexes back to its original shape.

As the brush roller repeatedly contacts and separates from the intermediate transfer belt, flexing the intermediate transfer belt continuously, rippling occurs in the intermediate transfer belt, thus resulting in undesirable vibration of the intermediate transfer belt. Such vibration hinders the intermediate transfer belt from reliably contacting the photoreceptors at their proper transfer positions, thus resulting in improper transfer of toner images. This improper transfer of the toner images may show up as banding in the resulting output image. In particular, when printing a halftone image, horizontal lines of narrow pitch appear in the image.

While prevention of vibration of the intermediate transfer belt is of critical importance, in order to achieve desirable transfer performance it is generally desirable to wind around and stretch the intermediate transfer belt between two rollers so that the intermediate transfer belt can reliably contact the photoreceptors and primary transfer rollers serving as the primary transfer device at a constant pressure. However, increasing demand for making an image forming apparatus as compact as possible does not always allow for such a configuration.

If the intermediate transfer belt is wound around the photoreceptors or the primary transfer rollers, the tension of the intermediate transfer belt causes the contact pressure between the photoreceptors and the primary transfer rollers to vary. This also results in improper transfer of the toner images.

In view of the above, a device that can reduce, if not prevent entirely, vibration of the intermediate transfer belt is required while also making the transfer device as compact as possible.

SUMMARY OF THE INVENTION

In view of the foregoing, in one illustrative embodiment of the present invention, a transfer device includes a pair of rollers, a rotatable intermediate transfer belt, a plurality of transfer members, a lubricant applicator, an opposing member, and a pressure member. The rotatable intermediate transfer belt is wound around and stretched between the pair of rollers to face a plurality of image bearing members for bearing toner images. Each of the plurality of transfer members faces a respective one of the plurality of the image bearing members through the intermediate transfer belt to transfer overlappingly the toner images onto the intermediate transfer belt to form a composite toner image thereon. The lubricant applicator is disposed upstream from the plurality of the image bearing members in a direction of rotation of the intermediate transfer belt and on the same plane on which the plurality of the image bearing members is disposed, to apply a lubricant to the intermediate transfer belt. The opposing member is disposed opposite the lubricant applicator through the intermediate transfer belt and contacts the intermediate transfer belt against the lubricant applicator. The pressure member is disposed upstream from the plurality of the image bearing members and downstream from the lubricant applicator in the direction of rotation of the intermediate transfer belt, to press against the intermediate transfer belt.

In another illustrative embodiment of the present invention, an image forming apparatus includes a plurality of image bearing members, a developing device, and a transfer device. The plurality of image bearing members bears an electrostatic latent image on a surface thereof. The developing device develops the electrostatic latent images formed on the image bearing members using toner to form a toner image. The transfer device includes a pair of rollers, a rotatable intermediate transfer belt, a plurality of transfer members, a lubricant applicator, an opposing member, and a pressure member. The rotatable intermediate transfer belt is wound around and stretched between the pair of rollers to face a plurality of image bearing members for bearing toner images. Each of the plurality of transfer members faces a respective one of the plurality of the image bearing members through the intermediate transfer belt to transfer overlappingly the toner images onto the intermediate transfer belt to form a composite toner image thereon. The lubricant applicator is disposed upstream from the plurality of the image bearing members in a direction of rotation of the intermediate transfer belt and on the same plane on which the plurality of the image bearing members is disposed, to apply a lubricant to the intermediate transfer belt. The opposing member is disposed opposite the lubricant applicator through the intermediate transfer belt and contacts the intermediate transfer belt against the lubricant applicator. The pressure member is disposed upstream from the plurality of the image bearing members and downstream from the lubricant applicator in the direction of rotation of the intermediate transfer belt, to press against the intermediate transfer belt.

Additional features and advantages of the present invention will be more fully apparent from the following detailed description of illustrative embodiments, the accompanying drawings and the associated claims.

BRIEF DESCRIPTION OF THE DRAWINGS

A more complete appreciation of the disclosure and many of the attendant advantages thereof will be readily obtained as the same becomes better understood by reference to the following detailed description of illustrative embodiments when considered in connection with the accompanying drawings, wherein.

DETAILED DESCRIPTION OF ILLUSTRATIVE EMBODIMENTS

Figure 1:
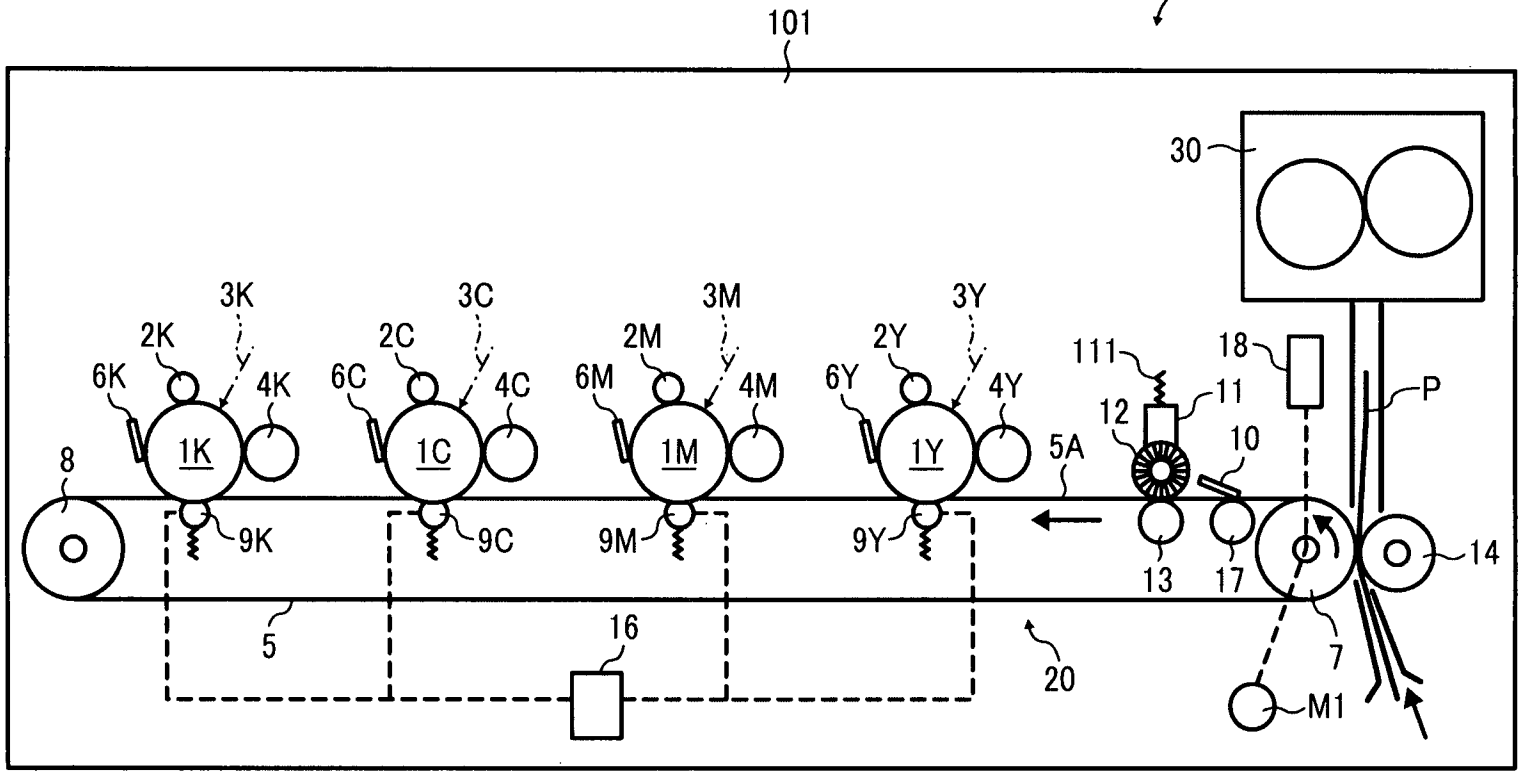
FIG. 1 is a schematic diagram illustrating an image forming apparatus including a transfer device according to the illustrative embodiment of the present invention.

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing illustrative embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In a later-described comparative example, illustrative embodiment, and alternative example, for the sake of simplicity, the same reference numerals will be given to constituent elements such as parts and materials having the same functions, and redundant descriptions thereof omitted.

Typically, but not necessarily, paper is the medium from which is made a sheet on which an image is to be formed. It should be noted, however, that other printable media are available in sheet form, and accordingly their use here is included. Thus, solely for simplicity, although this Detailed Description section refers to paper, sheets thereof, paper feeder, etc., it should be understood that the sheets, etc., are not limited only to paper, but includes other printable media as well.

Referring now to the drawings, wherein like reference numerals designate identical or corresponding parts throughout the several views, and initially to FIG. 1, one example of an image forming apparatus according to an illustrative embodiment of the present invention is described.

FIG. 1 is a schematic diagram illustrating a full-color printer as an example of an image foaming apparatus 100 according to the illustrative embodiment can be employed. The image forming apparatus 100 includes, but is not limited to a printer, a copier, and a multifunctional system including at least two of these functions.

A main body 101 of the image forming apparatus 100 includes a transfer device 20, charging devices 2Y, 2M, 2C, and 2K, developing devices 4Y, 4M, 4C, and 4K, an intermediate transfer belt 5 serving as an intermediate transfer device, cleaning blades 6Y, 6M, 6C, and 6K serving as cleaning devices, and photoreceptor drums 1Y, 1M, 1C, and 1K serving as image bearing members.

It is to be noted that reference characters Y, M, C, and K denote the colors yellow, magenta, cyan, and black, respectively.

The charging devices 2Y, 2M, 2C, and 2K, the developing devices 4Y, 4M, 4C, and 4K, the intermediate transfer belt 5, the cleaning blades 6Y, 6M, 6C, and 6K are disposed around the respective photoreceptor drums 1Y, 1M, 1C, and 1K.

When forming a color image, exposure light 3Y, 3M, 3C, and 3K illuminates a portion of each of the respective the photoreceptor drums 1Y, 1M, 1C, and 1K between the charging devices 2Y, 2M, 2C, and 2K, and the developing devices 4Y, 4M, 4C, and 4K, thereby forming latent images on each of the photoreceptor drums 1Y, 1M, 1C, and 1K. Subsequently, the latent images on the photoreceptor drums 1Y, 1M, 1C, and 1K are developed with toners of respective colors sequentially by the developing devices 4Y, 4M, 4C, and 4K. Then, the toner images formed on the photoreceptor drums 1Y, 1M, 1C, and 1K are transferred overlappingly onto the intermediate transfer belt 5, thereby forming a composite toner image.

The intermediate transfer belt 5 is made of resin, and wound around and stretched between a pair of rollers, that is, a secondary transfer opposing roller 7 and a tension roller 8. When the secondary transfer opposing roller 7 is driven by a drive motor M1, the intermediate transfer belt 5 is rotated in a counterclockwise direction indicated by an arrow. The photoreceptor drums 1Y, 1M, 1C, and 1K are arranged such that the photoreceptor drums 1Y, 1M, 1C, and 1K can contact a belt surface 5A of the intermediate transfer belt 5 stretched between a pair of roller, that is, the secondary transfer opposing roller 7 and the tension roller 8.

Primary transfer rollers 9Y, 9M, 9C, and 9K serving as primary transfer members are disposed in the inner loop of the intermediate transfer belt 5, facing each of the photoreceptor drums 1Y, 1M, 1C, and 1K, respectively. Each of the primary transfer rollers 9Y, 9M, 9C, and 9K is pressed against and contacts each of the photoreceptor drums 1Y, 1M, 1C, and 1K through the intermediate transfer belt 5 by urging members such as a spring.

Each of the primary transfer rollers 9Y, 9M, 9C, and 9K is supplied with a predetermined primary transfer bias for primary transfer process by a primary transfer bias applicator 16 (shown in FIG. 2) through a constant current control.

A tip of a belt cleaning blade 10 serving as a cleaning member is pressed against the belt surface 5A of the intermediate transfer belt 5 to clean residual toner, paper dust, and so forth adhered thereto. The belt cleaning blade 10 is formed of an elastic member such as urethane rubber or the like and disposed between the secondary transfer opposing roller 7 and the photoreceptor drum 1Y. The belt cleaning blade 10 is pressed against the belt surface 5A at a position posterior to the secondary transfer process, thereby removing the substance such as residual toner from the belt surface 5A.

In the inner loop of the intermediate transfer belt 5, a roller 17 is disposed facing the belt cleaning blade 10. In other words, the intermediate transfer belt 5 is sandwiched between the roller 17 and the belt cleaning blade 10.

A brush roller 12 is disposed between the photoreceptor drum 1Y and the belt cleaning blade 10, that is, upstream from the photoreceptor drum 1Y in the belt rotation direction, contactable relative to the belt surface. The brush roller 12 serves as a lubricant applicator that applies a lubricant 11 onto the surface of the intermediate transfer belt 5. The lubricant 11 includes, but is not limited to, fatty acid metal salts having a straight-chain hydrocarbon structure. The brush roller 12 consists of a metal core made of SUS or the like on which brush bristles made of polyester are adhered.

The direction of rotation of the brush roller 12 coincides with the direction of movement of the intermediate transfer belt 5. The brush roller 12 is rotated by a drive motor, not illustrated, at a rotation speed 1.2 times the speed of movement of the intermediate transfer belt 5.

Since the lubricant 11 is scraped by the brush roller 12, the lubricant 11 is pressed against the brush roller 12 by a pressure member 111 such as an elastic member including, but not limited to, a spring.

An opposing roller 13 formed of metal is disposed opposite the brush roller 12 via the intermediate transfer belt 5. An amount of the tip of the brush bristles of the brush roller 12 engaging the opposing roller 13 is configured to be approximately 1 mm.

A secondary transfer roller 14 serving as a secondary transfer member is disposed opposite the secondary transfer opposing roller 7 through the intermediate transfer belt 5. The secondary transfer roller 14 is driven by a drive gear, not illustrated. The secondary transfer opposing roller 7 is supplied with a predetermined secondary transfer bias by a secondary transfer bias applicator 18 through a constant current control.

As described above, according to the illustrative embodiment, the transfer device 20 includes the intermediate transfer belt 5, the primary transfer rollers 9Y, 9M, 9C, and 9K, the belt cleaning blade 10, the brush roller 12, the opposing roller 13, the primary transfer bias applicator 16, and the secondary transfer bias applicator 18.

In the image forming apparatus 100, toner images of yellow, magenta, cyan, and black are formed by the developing devices 4Y, 4M, 4C, and 4K on the respective photoreceptors 1Y, 1M, 1C, and 1K. Each of the toner images are transferred overlappingly onto the intermediate transfer belt 5 rotated by the drive motor M1 due to the primary transfer bias, thereby forming a composite toner image.

Subsequently, as the intermediate transfer belt 5 bearing the composite toner image arrives at a secondary transfer position, the composite toner image is transferred onto a recording medium P conveyed from a sheet feeding unit, not illustrated. After the composite toner image is transferred onto the recording medium P, the recording medium P is conveyed to a fixing device 30 disposed downstream in the conveyance direction of the recording medium, where heat and pressure are applied to the composite toner image to fix it onto the recording medium P. Then, the recording medium P is discharged onto a sheet tray, not illustrated.

After the secondary transfer process, the belt cleaning blade 10 removes the residual toner, paper powder, and so forth from the surface of the intermediate transfer belt 5. Then, the brush roller 12 applies the lubricant 11 on the intermediate transfer belt 5 in preparation for the subsequent toner image transfer process.

In order to facilitate an understanding of the related art and of the novel features of the present invention, a description is provided of a mechanism that generates undesirable vibration when a lubricant is applied.

Upon application of the lubricant 11, the brush roller 12 rotates opposite the opposing roller 13, generating undesirable vibration in the intermediate transfer belt 5. In a color image forming apparatus, vibration of the intermediate transfer belt 5 is transmitted to the photoreceptor drum 1Y of yellow disposed immediately downstream from the brush roller 12, causing banding in the toner image when the toner image is transferred from the photoreceptor drum 1Y to the intermediate transfer belt 5.

In a case of the monochrome image forming apparatus, when the brush roller 12 contacts the intermediate transfer belt 5 vibration of the intermediate transfer belt 5 is transferred to the photoreceptor of black.

In view of the foregoing, according to the illustrative embodiment, a vibration suppression mechanism is provided to the transfer device 20 to reduce, if not prevent entirely, vibration of the intermediate transfer belt 5.

[Embodiment 1]

Figure 2:
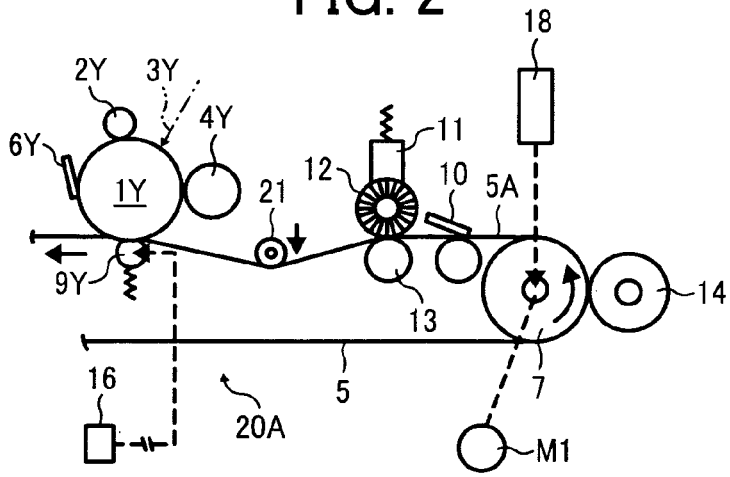
FIG. 2 is a partially enlarged schematic diagram illustrating the transfer device according to a first illustrative embodiment of the present invention.

With reference to FIG. 2, a description is provided of a transfer device 20A including the vibration suppression mechanism according to a first illustrative embodiment. FIG. 2 is a partially enlarged schematic diagram illustrating the transfer device 20A.

As illustrated in FIG. 2, the transfer device 20A includes a pressure roller 21 serving as a vibration suppression mechanism. The pressure roller 21 is disposed between the brush roller 12 and the photoreceptor 1Y, that is, downstream from the brush roller 12 in the direction of movement of the intermediate transfer belt 5, to press the intermediate transfer belt 5 from the outer surface thereof.

The pressure roller 21 is disposed between the photoreceptor drum 1Y and the brush roller 12 to press the belt surface 5A of the intermediate transfer belt 5 so that tension is applied to the intermediate transfer belt 5 between the photoreceptor 1Y and the brush roller 12. Accordingly, vibration of the intermediate transfer belt 5 due to rotation of the brush roller 12 is suppressed, if not prevented entirely, thereby preventing transmission of the vibration to the photoreceptor drum 1Y and thus an abnormal image.

[Embodiment 2]

Figure 3A:
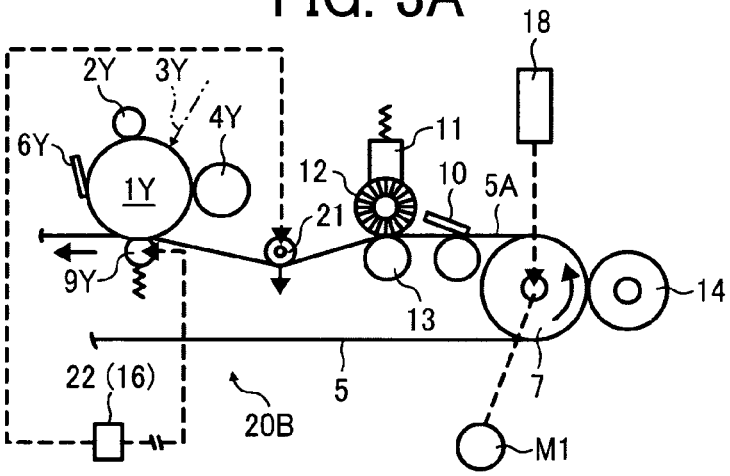
FIGS. 3A and 3B are partially enlarged schematic diagrams illustrating the transfer device according to a second illustrative embodiment of the present invention.
Figure 3B:
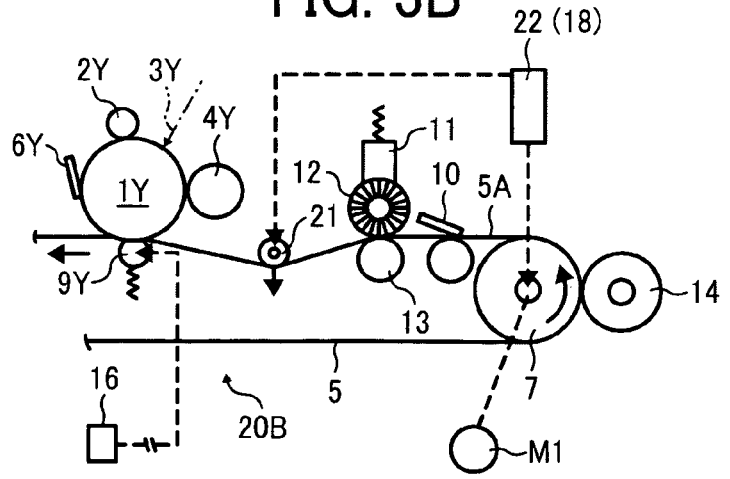

With reference to FIGS. 3A and 3B, a description is provided of a transfer device 20B according to a second illustrative embodiment. FIG. 3A is a partially enlarged schematic diagram illustrating the transfer device 20B including the pressure roller 21 and a voltage applicator 22 serving as a first voltage applicator that supplies the pressure roller 21 with a voltage. According to the present embodiment, the polarity of the bias provided from the voltage applicator 22 to the pressure roller 21 is the same polarity as that of the toner.

Figures 4A, 4B, 4C:
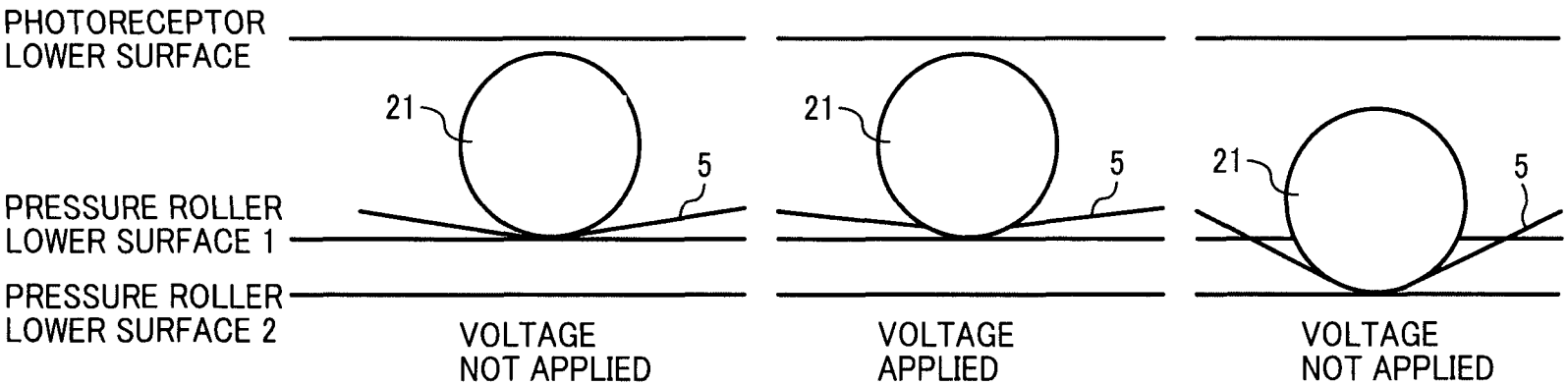
FIG. 4A is a schematic diagram illustrating a pressure member of the transfer device of FIGS. 3A and 3B when applied with a bias.
FIG. 4B is a schematic diagram illustrating the pressure member when no bias is applied.
FIG. 4C is a schematic diagram illustrating the pressure member at which the pressure member attains a proper transfer area when no bias is applied.

Supplying the voltage (bias) to the pressure roller 21 causes the pressure roller 21 and the intermediate transfer belt 5 to absorb electrostatically. An advantage of this configuration is that when the pressure roller 21 supplied with the voltage is pressed down by a certain amount relative to the lower surface of the photoreceptor drum 1 as illustrated in FIG. 4B, an area of contact between the pressure roller 21 and the intermediate transfer belt 5 is greater than when the pressure roller 21 without the voltage is pressed by the same amount as illustrated in FIG. 4A. In other words, in order to obtain the same area of contact between the pressure roller 21 and the intermediate transfer belt 5 as that of when supplied with the voltage, the pressure roller 21 needs to be pressed further down (the pressure roller lower surface 2) as illustrated in FIG. 4C.

Supplying the bias to the pressure roller 21 can reduce the amount of press or movement of the pressure roller 21 as compared with supplying no bias to the pressure roller 21, thus reducing mechanical stress against the intermediate transfer belt 5 and resulting in extending the life of the intermediate transfer belt 5. For example, if the amount of press by the pressure roller 21 is relatively large, a force in a direction moving away from the photoreceptor drum acts on the primary transfer roller 9Y disposed upstream in the direction of movement of the intermediate transfer belt 5, causing the primary transfer roller 9Y to separate undesirably from the photoreceptor 1Y and thus fluctuations in a nip width and a nip pressure between the photoreceptor 1Y and the intermediate transfer belt 5.

Furthermore, supplying the polarity same as that of the toner causes a repulsive force to act between the toner and the pressure roller 21, thereby reducing, if not preventing entirely, the toner that slips through the contact portion between the belt cleaning blade 10 and the intermediate transfer belt 5 from sticking to the pressure roller 21.

As a power source constituting the voltage applicator 22, a power source dedicated for the voltage applicator 22 can be provided. Alternatively, however, as illustrated in FIG. 3A, the power source constituting the primary transfer bias applicator 16 may also serve as the voltage applicator 22. Furthermore, as illustrated in FIG. 3B, the power source constituting the secondary transfer bias applicator 18 may also serve as the voltage applicator 22. In this configuration, no power source dedicated for the voltage applicator 22 is needed, thereby reducing the cost as well as the size of the transfer device.

[Embodiment 3]

Figure 5:
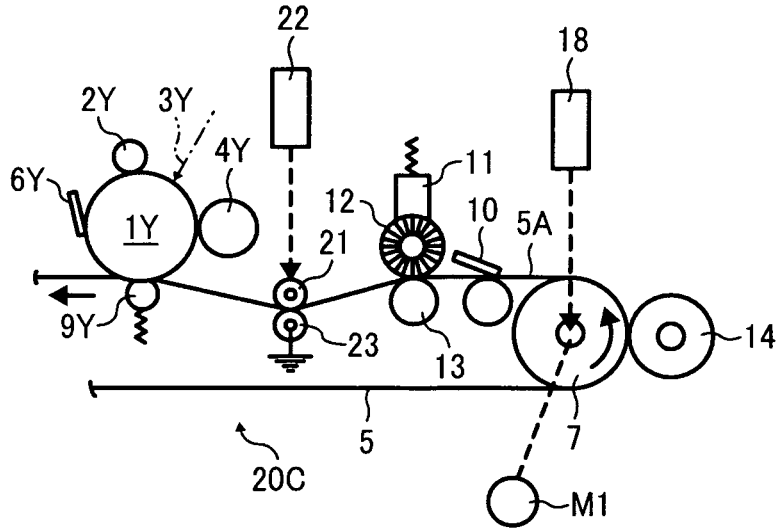
FIG. 5 is a partially enlarged schematic diagram illustrating a transfer device according to a third illustrative embodiment of the present invention.

With reference to FIG. 5, a description is now provided of a transfer device 20C according to a third illustrative embodiment. FIG. 5 is a partially enlarged schematic diagram illustrating the transfer device 20C including an opposing pressure roller 23.

As illustrated in FIG. 5, the opposing pressure roller 23 is disposed across from the pressure roller 21 through the intermediate transfer belt 5.

According to the present embodiment, the voltage applicator 22 supplies the pressure roller 21 with a voltage that causes the toner adhered to the pressure roller 21 to move toward the intermediate transfer belt 5. The opposing pressure roller 23 is disposed in the inner loop of the intermediate transfer belt 5 and connected to ground.

According to the present embodiment, the voltage applicator 22 applies alternately the voltages having polarities same as and different from the polarity of the toner to the pressure roller 21 with a predetermined timing, that is, after the image forming operation is finished, for example. The voltages having the polarity same as and different from that of the toner are hereinafter referred collectively to as a cleaning voltage (cleaning bias). The voltage applicator 22 applies alternately the voltages of negative and positive polarities (cleaning bias) to the pressure roller 21.

In this configuration, when supplying alternately the voltages of the positive and the negative polarities to the pressure roller 21, the well-charged toner adhering to the pressure roller 21 migrates to the intermediate transfer belt 5 due to the voltage having the negative polarity.

In a case of the toner not fully charged, for example, the oppositely charged toner or low-charged toner adhering to the pressure roller 21, such toner migrates to the intermediate transfer belt 5 when supplied with the voltage having the positive polarity.

By supplying alternately the voltage of the positive and the negative polarities to the pressure roller 21, the toner having different polarities adhering to the pressure roller 21 can be cleaned, thereby reducing, if not preventing entirely, the toner adhering to the pressure roller 21 from migrating onto the intermediate transfer belt 5 during the image foaming operation. In this configuration, the voltage applicator 22 serves as a cleaning voltage application mechanism.

It is preferable to supply the bias voltage, that is, to initiate cleaning of the pressure roller 21, after a predetermined number of image forming operation is performed. In other words, it is preferable that the bias voltage be supplied (cleaning be initiated) after a predetermined cumulative number of image forming operation or a predetermined cumulative time elapses, and after a sequence of the image forming operation is finished.

With this configuration, the pressure roller 21 is cleaned periodically, thus reducing, if not preventing entirely, generation of an abnormal image for an extended period of time.

In a case in which an abnormal state such as paper jamming occurs during the image forming operation, the pressure roller 21 is cleaned by supplying alternatively the voltages of the negative and the positive polarities thereto after the abnormal state is cancelled. With this configuration, even when a significant amount of toner remaining on the intermediate transfer belt 5 that has not been transferred onto the recording medium P due to the abnormal state of the image forming apparatus slips through the contact portion between the belt cleaning blade 10 and the intermediate transfer belt 5 thus contaminating the pressure roller 21, the toner can be removed reliably from the pressure roller 21, thereby reducing, if not preventing entirely, generation of an abnormal image.

[Embodiment 4]

Figure 6:
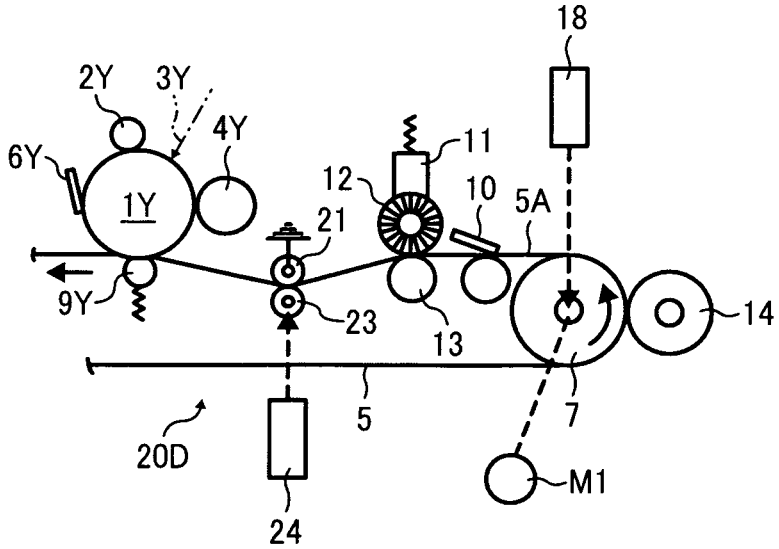
FIG. 6 is a partially enlarged schematic diagram illustrating a transfer device according to a fourth illustrative embodiment of the present invention.

With reference to FIG. 6, a description is now provided of a transfer device 20D according to a fourth illustrative embodiment. FIG. 6 is a partially enlarged schematic diagram illustrating the transfer device 20D including a voltage applicator 24 serving as a second voltage applicator that supplies the opposing pressure roller 23 with voltage. The polarity of bias is configured to be opposite the polarity of the toner.

In this configuration, when the bias is supplied to the opposing pressure roller 23, the opposing pressure roller 23 and the intermediate transfer belt 5 absorb each other electrostatically, thereby suppressing vibration of the intermediate transfer belt 5 easily. Since the polarity of the bias is opposite the polarity of the toner, it is made possible to generate an electric field that causes the toner to migrate from the pressure roller 21 to the opposing pressure roller 23. Accordingly, the toner slipping through the contact portion between the belt cleaning blade 10 and the intermediate transfer belt 5 is prevented from adhering to the pressure roller 21.

[Embodiment 5]

Figure 7:
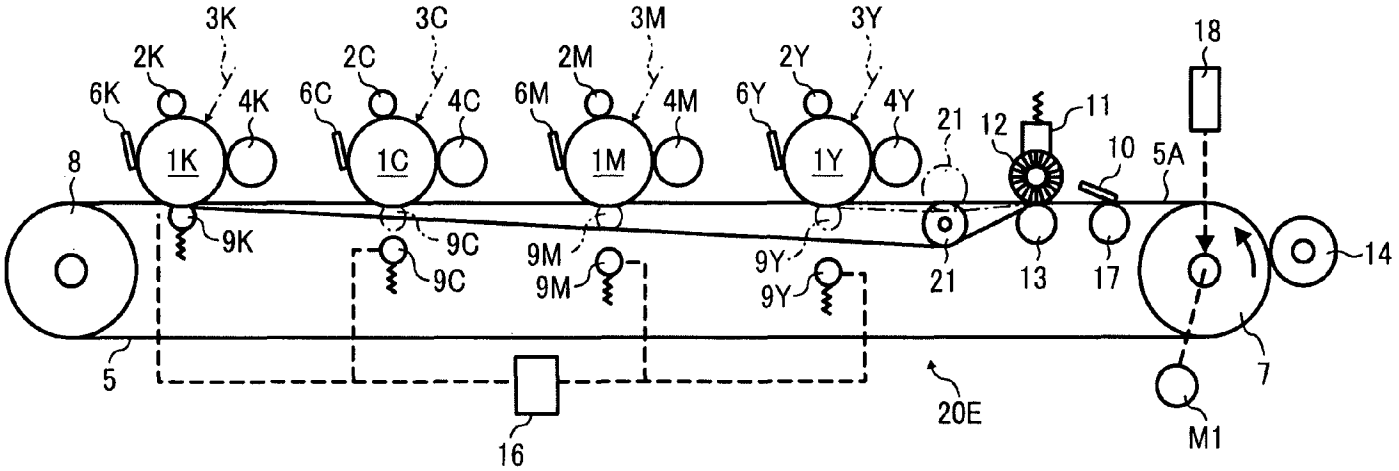
FIG. 7 is a partially enlarged schematic diagram illustrating a transfer device according to a fifth illustrative embodiment of the present invention.

With reference to FIG. 7, a description is now provided of a transfer device 20E according to a fifth illustrative embodiment. FIG. 7 is a partially enlarged schematic diagram illustrating the transfer device 20E in which the position of the pressure roller 21 is changeable from a position indicated by a broken line to a position indicated by a solid line.

Generally, monochrome printing is performed frequently in the color image forming apparatus 100. When monochrome printing is performed in the color image forming apparatus 100, the position of the primary transfer roller 9K for black is fixed while the rest of the primary transfer rollers 9Y, 9M, and 9C are separated from the corresponding photoreceptor drums 1Y, 1M, and 1C so that the primary transfer rollers 9Y, 9M, and 9C do not contact the photoreceptor drums 1Y, 1M, and 1C. The toner image in black is formed using the photoreceptor drum 1K.

Figure 8:
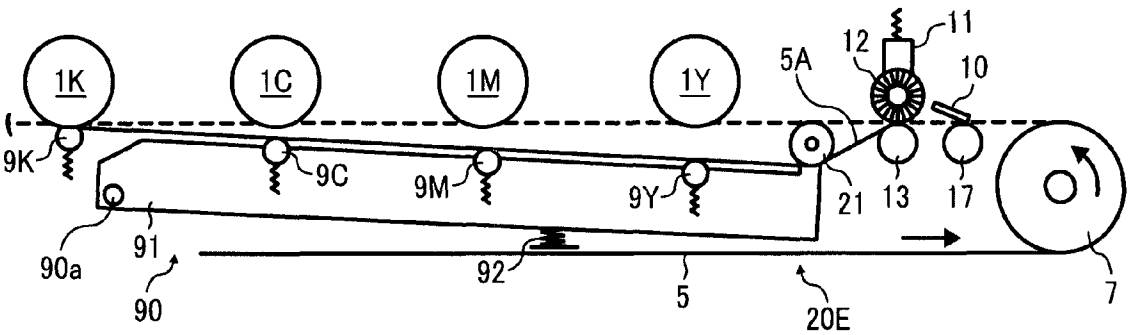
FIG. 8 is an enlarged schematic diagram illustrating a moving device and the pressure member when moved by the moving device.

In view of the foregoing, as illustrated in FIG. 8, the transfer device 20E according to the present embodiment includes a moving device 90 that moves the pressure roller 21 from the position indicated by the broken line to the solid line while separating the primary transfer rollers 9Y, 9M, and 9C from the photoreceptor drums 1Y, 1M, and 1C.

As illustrated in FIG. 8, the moving device 90 includes a shaft 90*a*, a base plate 91, a spring 92, and a drive source, not illustrated. The base plate 91 is swingably disposed about the shaft 90*a*. The spring 92 urges the base plate 91 against the photoreceptor drums 1Y, 1M, and 1C. The drive source changes the position of the base plate 91 from the photoreceptor drum side to a position away from the photoreceptor drums (hereinafter referred to as a separating position). A motor and a gear mechanism may be employed as the drive source. Alternatively, an electromagnetic solenoid may be employed as the drive source.

According to the present embodiment, the primary transfer rollers 9Y, 9M, and 9C as well as the pressure roller 21 are provided to the base plate 91, thereby enabling the pressure roller 21 to move together with the primary transfer rollers 9Y, 9M, and 9C when the primary transfer rollers 9Y, 9M, and 9C separate from the photoreceptor drums 1Y, 1M, and 1C, thus causing the intermediate transfer belt 5 to separate from the photoreceptor drums 1Y, 1M, and 1C.

In both FIGS. 7 and 8, the broken lines opposite the photoreceptor drums indicate a position when performing the full color image forming operation. By contrast, the solid lines indicate a separating position when performing monochrome image forming operation (black).

When forming a monochrome image, the drive source of the moving device 90 is operated so as to move the base plate 91 downward in FIG. 7, thereby enabling the pressure roller 21 as well as the primary transfer rollers 9Y, 9M and 9C to move to the separating position illustrated in FIG. 8.

If the primary transfer rollers 9Y, 9M and 9C are provided to the base plate 91 without the pressure roller 21 and the pressure roller 21 provided separately is urged downward in advance, it is still possible to separate the intermediate transfer belt 5 from the photoreceptor drums 1Y, 1M, and 1C by moving the primary transfer rollers 9Y, 9M and 9C.

However, although effective, this configuration has a drawback. That is, because the pressure roller 21 is urged downward in advance, when forming a full color image, a significant force in the direction of the separating position, acts on the primary transfer roller 9Y, thereby moving undesirably the primary transfer roller 9Y away from the photoreceptor drum 1Y. As a result, the nip width and the nip pressure between the photoreceptor drum 1Y and the intermediate transfer belt 5 fluctuate undesirably.

By contrast, according to the illustrative embodiment, when forming a monochrome image, enabling the pressure roller 21 to move from the position of forming the full color image indicated by the broken line illustrated in FIG. 7 to the position of forming a monochrome image indicated by the solid line can minimize the pressing force of the pressure roller 21 relative to the belt surface 5A of the intermediate transfer belt 5, thereby stabilizing the nip width and the nip pressure between the photoreceptor drum 1Y and the intermediate transfer belt 5.

Furthermore, providing both the pressure roller 21 and the primary transfer rollers 9Y, 9M, and 9C to the single moving member, that is, the moving member 90, requires no dedicated moving member for moving the pressure roller 21, thereby reducing the cost and the size of the device.

As mentioned above, the pressure roller 21 is provided to the moving member 90 on which the primary rollers 9Y, 9M, and 9C are also provided so that the pressure roller 21 moves together with the primary rollers 9Y, 9M, and 9C. However, the moving mechanism is not limited to the above described configuration. Alternatively, the position of the shaft of the pressure roller 21 may be changeable such that the shaft thereof is supported movably by a frame of the transfer device or the image forming apparatus, and an arm member or a hook provided to the moving member 90 extending to the shaft of the pressure roller 21 engages the shaft. Accordingly, as the moving member 90 moves, the pressure roller 21 can move in conjunction with the moving member 90.

According to the illustrative embodiment, the present invention is employed in the image forming apparatus. The image forming apparatus includes, but is not limited to, a copier, a printer, a facsimile machine, and a multi-functional system including at least two of these functions.

Furthermore, it is to be understood that elements and/or features of different illustrative embodiments may be combined with each other and/or substituted for each other within the scope of this disclosure and appended claims. In addition, the number of constituent elements, locations, shapes and so forth of the constituent elements are not limited to any of the structure for performing the methodology illustrated in the drawings.

Still further, any one of the above-described and other exemplary features of the present invention may be embodied in the form of an apparatus, method, or system.

For example, any of the aforementioned methods may be embodied in the form of a system or device, including, but not limited to, any of the structure for performing the methodology illustrated in the drawings.

Example embodiments being thus described, it will be obvious that the same may be varied in many ways. Such exemplary variations are not to be regarded as a departure from the scope of the present invention, and all such modifications as would be obvious to one skilled in the art are intended to be included within the scope of the following claims.

What is claimed is:

1. A transfer device, comprising:

a pair of rollers;

a rotatable intermediate transfer belt wound around and stretched between the pair of rollers to face a plurality of image bearing members for bearing toner images;

a plurality of transfer members, each facing a respective one of the plurality of the image bearing members through the intermediate transfer belt, to transfer overlappingly the toner images onto the intermediate transfer belt to form a composite toner image thereon;

a lubricant applicator disposed upstream from the plurality of the image bearing members in a direction of rotation of the intermediate transfer belt and the lubricant applicator being on the same plane on which the plurality of the image bearing members is disposed, to apply a lubricant to the intermediate transfer belt;

an opposing member disposed opposite the lubricant applicator through the intermediate transfer belt, to contact the intermediate transfer belt against the lubricant applicator; and a pressure member disposed upstream from the plurality of the image bearing members and downstream from the lubricant applicator in the direction of rotation of the intermediate transfer belt, to press against the intermediate transfer belt, wherein the pressure member presses against an outer circumference of the intermediate transfer belt, the outer circumference is the same surface to which the lubricant is applied.

2. The transfer device according to claim 1, wherein the pressure member presses against the outer circumference of the intermediate transfer belt.

3. The transfer device according to claim 1 further comprising a first voltage applicator that applies a voltage to the pressure member.

4. The transfer device according to claim 3, wherein the voltage applied by the first voltage applicator to the pressure member has a polarity identical to that of the toner image on the image bearing members or of a developing agent.

5. The transfer device according to claim 3, wherein the first voltage applicator includes a power source.

6. The transfer device according to claim 5, wherein the power source of the first voltage applicator provides a transfer bias when transferring the toner images from the image bearing members to the intermediate transfer belt.

7. The transfer device according to claim 5, further comprising a secondary transfer member that transfers the composite toner image from the intermediate transfer belt onto a recording medium, wherein the power source of the first voltage applicator provides a secondary transfer bias to the secondary transfer member when transferring the composite toner image from the intermediate transfer belt to the recording medium.

8. The transfer device according to claim 3, wherein the first voltage applicator applies a cleaning voltage to the pressure member between image forming operations to move residual toner adhering to the pressure member to the intermediate transfer belt.

9. The transfer device according to claim 8, wherein the first voltage applicator applies the voltage to the pressure member after a threshold number of image forming operations is performed.

10. The transfer device according to claim 8, wherein the voltage applicator applies the voltage to the pressure member after a certain cumulative operating time elapses.

11. The transfer device according to claim 8, wherein the first voltage applicator applies the cleaning voltage to the pressure member after correction of a malfunction during an image forming operation.

12. The transfer device according to claim 1, further comprising:

an opposing pressure member disposed opposite the pressure member through the intermediate transfer belt; and a second voltage applicator to apply a voltage having a polarity opposite the polarity of the toner of the toner image or of a developing agent to the opposing pressure member.

13. The transfer device according to claim 1, further comprising:

a moving device that separates all but one of the transfer members from the respective image bearing members, wherein, when the moving device separates the transfer members from the image bearing members, the pressure member is moved so as to separate the intermediate transfer belt from the image bearing members.

14. The transfer device according to claim 13, wherein the moving device moves the pressure member.

15. An image forming apparatus, comprising:

a plurality of image bearing members to bear an electrostatic latent image on a surface thereof;

a developing device to develop the electrostatic latent images formed on the image bearing members using toner to form a toner image; and a transfer device including a pair of rollers;

a rotatable intermediate transfer belt wound around and stretched between the pair of rollers to face the plurality of image bearing members of the image forming apparatus;

a plurality of transfer members, each facing a respective one of the plurality of the image bearing members through the intermediate transfer belt, to transfer overlappingly the toner images onto the intermediate transfer belt to form a composite toner image on the intermediate transfer belt;

a lubricant applicator disposed upstream from the plurality of the image bearing members in a direction of rotation of the intermediate transfer belt and the lubricant applicator being on the same plane on which the plurality of the image bearing members is disposed, to apply a lubricant to the intermediate transfer belt;

an opposing member disposed opposite the lubricant applicator to contact the intermediate transfer belt against the lubricant applicator; and a pressure member disposed upstream from the plurality of the image bearing members and downstream from the lubricant applicator in the direction of rotation of the intermediate transfer belt, to press against the intermediate transfer belt, wherein the pressure member presses against an outer circumference of the intermediate transfer belt, the outer circumference is the same surface to which the lubricant is applied.

16. The transfer device according to claim 1, wherein the pressure member causes the intermediate transfer belt to deform in an inwardly direction with respect to a center of the intermediate transfer belt.

* * * * *